United States Patent [19]

Hildebrandt

[11] Patent Number: 4,718,556

[45] Date of Patent: Jan. 12, 1988

[54] BAG

[75] Inventor: Bodo Hildebrandt, Riedstadt, Fed. Rep. of Germany

[73] Assignee: Wella AG, Darmstadt, Fed. Rep. of Germany

[21] Appl. No.: 887,825

[22] PCT Filed: Oct. 26, 1985

[86] PCT No.: PCT/EP85/00567

§ 371 Date: Jul. 10, 1986

§ 102(e) Date: Jul. 10, 1986

[87] PCT Pub. No.: WO86/02908

PCT Pub. Date: May 22, 1986

[30] Foreign Application Priority Data

Nov. 15, 1984 [DE] Fed. Rep. of Germany ..... 3441797

[51] Int. Cl.[4] ..... B65D 33/02; B65D 27/34; B65D 27/36

[52] U.S. Cl. ..... 206/604

[58] Field of Search ..... 206/604, 484, 628

[56] References Cited

U.S. PATENT DOCUMENTS

| | | | |
|---|---|---|---|
| 3,164,695 | 1/1965 | Sanni | 206/484 |
| 3,179,327 | 4/1965 | Burton et al. | 206/620 |
| 3,580,390 | 5/1971 | Shull, Jr. | 206/484 |
| 3,625,351 | 12/1971 | Eisenberg | 206/604 |
| 3,635,376 | 1/1972 | Hellstrom | 206/620 |
| 4,027,819 | 6/1977 | Herrera-Gutierrez | 206/601 |

*Primary Examiner*—Stephen P. Garbe
*Attorney, Agent, or Firm*—Michael J. Striker

[57] ABSTRACT

A bag (1), e.g. a sachet for holding portions of paste or liquid such as shampoos or bath additives, made from sheet material (2) has an edge (4) closed by a flat connecting seam (8). A tear zone (10) is provided in the outer region of the connecting seam (8). To facilitate tearing open of the bag (1), a rod (9) is provided in a portion of the connecting seam (8) extending on both sides of the tear zone (10), and extends in the longitudinal direction of the seam.

6 Claims, 2 Drawing Figures

BAG

TECHNICAL FIELD

This invention relates to a bag having an edge closed by a flat connecting seam and a tear zone in the outer region of the seam.

The bag may be a flat bag or sachet, more particularly for holding portions of paste or liquids such as shampoos or bath additives and made out of a preferably folded foil or sheet, the edge closed by the flat connecting seam being adjacent the folded edge. The bag is torn in a direction parallel to the folded edge.

BACKGROUND ART

Known sachets for holding shampoos and bath additives are made from sheet material, preferably of plastics or aluminium or paper or a combination of these materials. In the case of a sachet of rectangular form, the sheet material is usually folded and the fold forms a closed side edge, whereas the other three edges are each closed by a flat connecting seam, which may be welded, glued, or sealed. In order to facilitate opening the folded bag at a predetermined place or "tear zone", a nick and/or a slightly pre-perforated tear line is formed in the outer region of one connecting seam. In order to improve the grip of the fingers during the tearing-open process, the grip surfaces of the flat bag can be structured or otherwise roughened, at least near the tear zone. In spite of these special grip surfaces, it is difficult to tear open such a bag, at least with wet fingers. This is partly because the foil or sheet forming the bag is very thin, and is therefore more difficult to grasp or take hold of in a positive interlocking and/or frictional manner. In addition, fingers tend to slip when covered with a film of moisture.

It would therefore be desirable to be able to construct a bag so that the tearing-open process is facilitated and, more particularly, is possible with damp or wet fingers.

DISCLOSURE OF INVENTION

According to the present invention a rod is provided within the seam, the rod extending on both sides of the tear zone longitudinally of the seam.

The rod incorporated in the connecting seam enables the bag to be securely gripped for tearing open. If the rod is formed in one piece, it is broken at the tear zone or tear line, the fingers of both hands grasping part of the tear rod; to facilitate breaking the rod can be formed with a predetermined breaking zone or notch at the tear zone. Alternatively, the rod can be made up of two parts disposed end to end, the adjacent ends of the two parts being disposed at the tear zone (on the tear line). To avoid having to align the rod before insertion into the connecting seam, it may have two predetermined breaking zones or notches, each at a distance from a respective one of its free ends, so that the rod can be supplied and inserted in either direction.

To facilitate manufacture of the bag, the rod is preferably in the middle of a double connecting seam. The rod may be made of brittle, easily breakable material, e.g. plastics.

BRIEF DESCRIPTION OF DRAWINGS

The invention will be described further, by way of example, with reference to the accompanying drawings, in which.

BEST MODE FOR CARRYING OUT THE INVENTION

Figure 1:
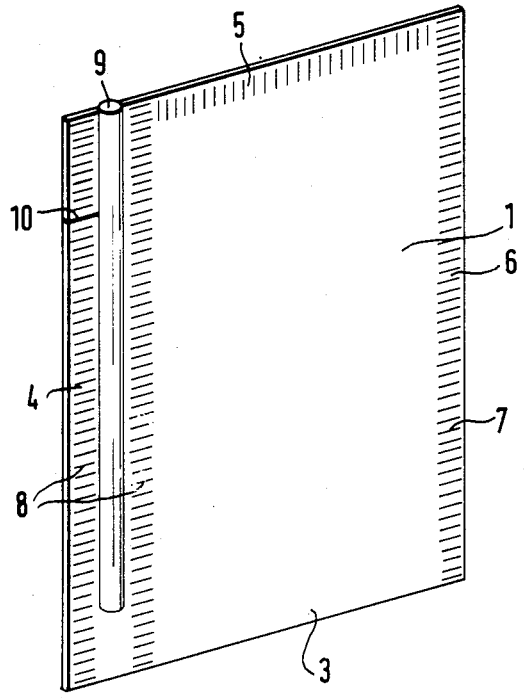
FIG. 1 is a perspective view of a sachet.
Figure 2:
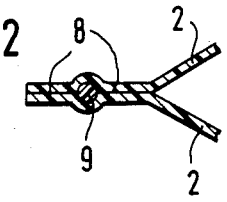
FIG. 2 is an enlarged section through part of the sachet in the region of the rod.

The sachet 1, e.g. for holding shampoo, is in the form of a substantially flat bag having a rectangular shape and made of laminated plastics foil 2. In the illustrated embodiment, the foil 2 is folded at its bottom edge 3, whereas the other three edges 4,5,6 are firmly interconnected by a flat welded connecting seam 7. A double connecting seam 8 is formed at one edge 4, and in the space between the individual longitudinal portions of the double seam 8 a free space is left for receiving a tear rod 9 made, for example, of brittle, easily breakable plastics. A tear zone in the form of a perforated, cut, or notched tear line 10 is disposed in the outer region of the double connecting seam 8 and at a distance from the top edge 5, so that the rod 9 extends on both sides of the tear zone or tear line 10. Normally the rod 9 is completely welded inside the double seam 8, which is closed at its ends.

The sachet 1 is opened or torn open by being gripped by two fingers of each hand on each side of the tear line 10, gripping being facilitated by the tear rod 9. At this stage, the rod 9 is broken and for this purpose it has a notch or other weakening in line with the tear line 10, so that a part of the rod 9 is held between the fingers of each hand. This makes it easier to tear the sachet 1, since the fingers, owing to the reinforcements supplied by the parts of rod 9, do not now slip off the sachet 1 so easily.

In the illustrated embodiment, the rod 9 extends over almost the entire length of the edge 4 of the sachet 1. Alternatively, the rod 9 can be made shorter, provided its length is such that it can easily be gripped by the fingers even when broken. Normally the rod 9 is only held positively in the middle of the double connecting seam 8, but if necessary the rod can additionally be secured to the foil 2 by gluing.

A separate notch or predetermined breaking place can be provided at a distance from each end of the rod 9, thus avoiding the need to align the rod before inserting it into the double connecting seam.

As an alternative to the illustrated embodiment, the rod 9 can be formed in two parts, in which case the two parts of the rod 9 are disposed end to end and the joint between the parts is in line with the tear line 10.

I claim:

1. A bag (1) having an edge (4) closed by a flat connecting seam (8) and a tear zone (10) in the outer region of said seam (8), and further including a rod (9) positioned within said seam (8), the rod (9) extending longitudinally of the seam (8) and extending at both sides of the tear zone, said rod being made of brittle, easily breakable material.

2. A bag as claimed in claim 1, wherein said rod (9) is of one piece and has a predetermined breaking zone adjacent the tear zone.

3. A bag as claimed in claim 1, wherein the rod (9) is made of plastics.

4. A bag as claimed in claim 1, wherein said rod (9) is completely welded in the said seam (8).

5. A bag as claimed in claim 1, wherein the tear zone (10) is defined by a cut or perforated line.

6. A bag as claimed in claim 1, which is substantially flat and is formed of folded sheet material.

* * * * *